US006357744B1

(12) United States Patent
Ho

(10) Patent No.: US 6,357,744 B1
(45) Date of Patent: Mar. 19, 2002

(54) PLAYER STRUCTURE IN A FOOZ BALL GAME

(76) Inventor: Tsai Chin Ho, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/523,929

(22) Filed: Mar. 13, 2000

(51) Int. Cl.[7] ..... A63F 7/07
(52) U.S. Cl. ..... 273/108.52; 273/108.54
(58) Field of Search ..... 273/108.1, 108.52, 273/108.54, 108.55, 108.56, 129 R; 446/366, 367, 325; D21/318, 357, 386

(56) References Cited

U.S. PATENT DOCUMENTS 3,627,322 A * 12/1971 Leonhart
3,945,640 A * 3/1976 Denmark
4,411,096 A * 10/1983 Smith

FOREIGN PATENT DOCUMENTS

EP 000500476 * 8/1992 ..... 273/85 D

* cited by examiner

*Primary Examiner*—Sebastiano Passaniti
(74) *Attorney, Agent, or Firm*—Charles E. Baxley

(57) ABSTRACT

A player structure in a fooz-ball game includes a body having a passage through which a shaft extends. A bolt receiving hole and a position hole are respectively defined in the body such that a bolt extends through the bolt receiving hole and the shaft and us securely engaged with the position hole. A first weight is received in a recess defined in a top of the body and a second weight is connected to a lower end of the body. The player is maintained at a position where the second weight is hanging above the floor of the machine so that a ball can pass below the players without impediment.

2 Claims, 3 Drawing Sheets

PLAYER STRUCTURE IN A FOOZ BALL GAME

FIELD OF THE INVENTION

The present invention relates to a player structure in a fooz-ball game wherein the lower end of the players may be maintained at a position above the floor to let ball pass through below the players.

BACKGROUND OF THE INVENTION

A conventional fooz-ball game is shown in FIG. 1 and generally includes a box-like body 10 with an open top, and four sidewalls 11 extend from the floor of the body 10. Five shafts 10 rotatably extend through two opposite sidewalls 11 and each shaft 10 has two handles 100 on two ends thereof. A plurality of players 15 or men are fixedly connected to the shafts 10 by a locking bolt 16 extending through the player 1 5 and securely engaging the shaft 10 as shown in FIG. 1. When rotating the shafts 10, the players 15 are rotated. Each player 15 is shaped as a real football player shape and the shaft 10 extends through a position about the shoulder of the players 15. It is to be noted that the length below the shaft 10 of the player 15 is longer than the length above the shaft 10 of the player 15 so that the players 15 are always maintained in a vertical position relative to the floor 12 due to gravity. A block 150 is connected to a lower end of each player 15 so as to hit a ball on the floor 12. Because the players 15 are always oriented vertically to the floor 12 so that the ball will be stopped by the players 15 during playing the game and this reduces the pitch of the game.

The present invention intends to provide a player structure wherein each player has a first weight on an upper end thereof and a second weight on a lower end so that when the players are rotated over a certain angle relative to the floor, the players is maintained at that position so that ball can quickly pass below the players.

SUMMARY OF THE INVENTION

In accordance with one aspect of the present invention, there is provided a player structure in a fooz-ball game, and comprising a body having a passage for a shaft extending therethrough and a bolt extends through a bolt receiving hole in the body of the player and the shaft, and engaged with a position hole in alignment with the bolt receiving hole. A recess is defined in a top of the body so as to receive a first weight therein, and a second weight is connected to a lower end of the body.

The object of the present invention is to provide a player in a fooz-ball game wherein the top end of each player has a weight connected thereto so that the lower end of the player can be maintained above the floor of the game to allow the ball pass below the lower end of the players quickly.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
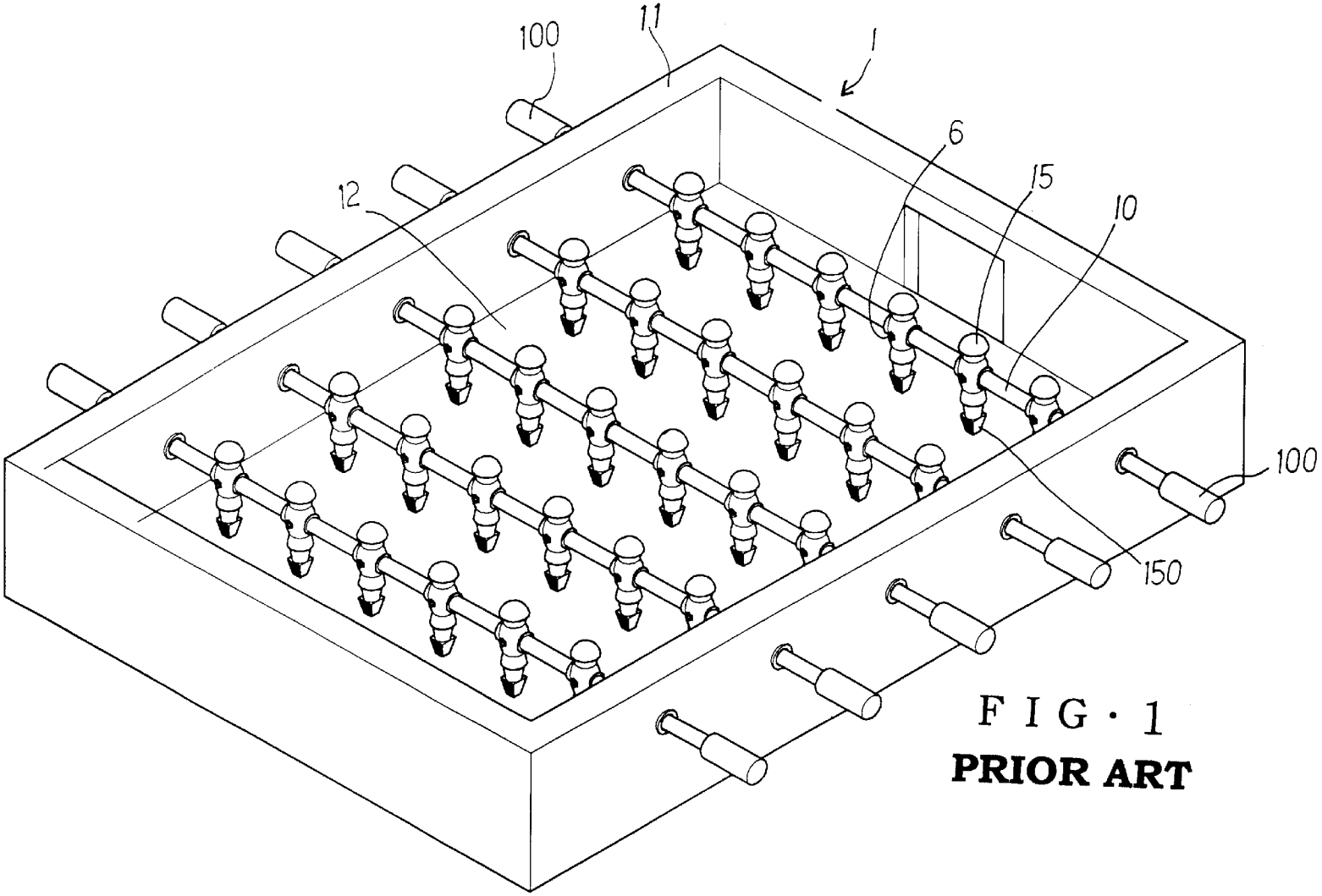
FIG. 1 PRIOR ART
FIG. 1 is a perspective view to show a conventional fooz-ball game.
Figure 3:
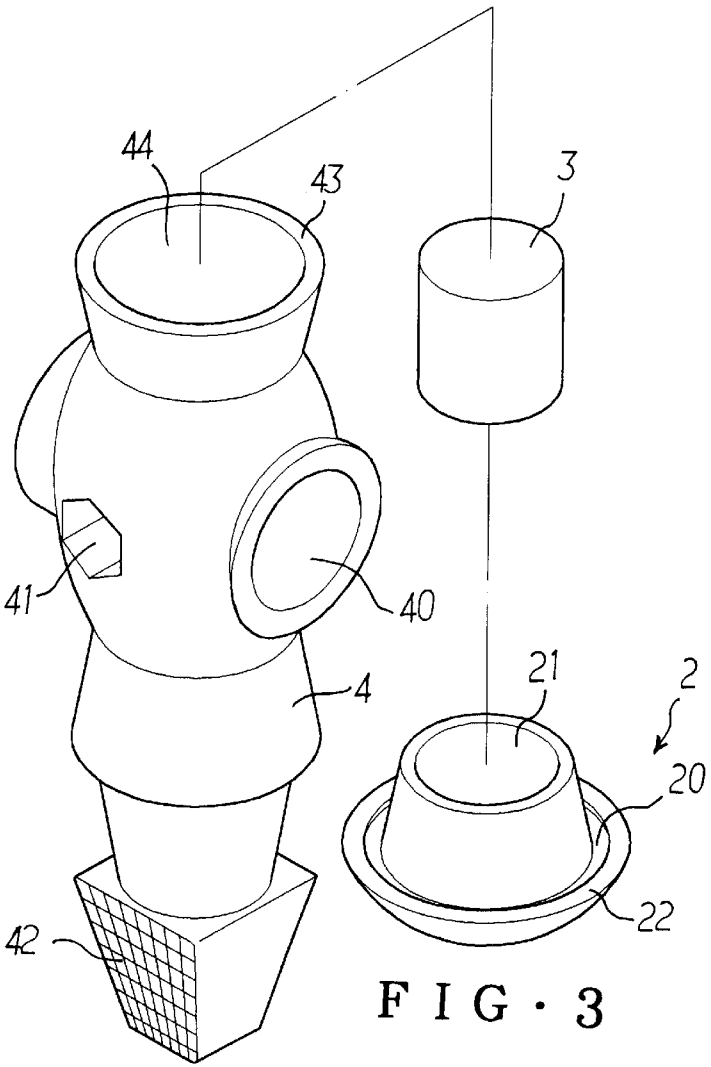
FIG. 3 is an exploded view to show a player of the present invention.
Figure 4:
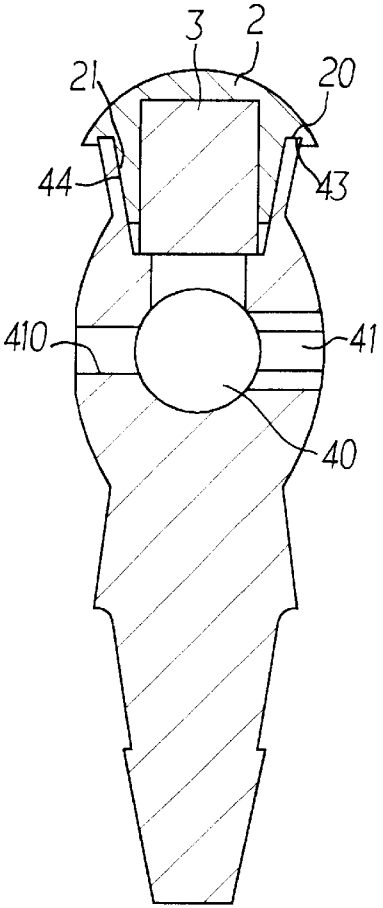
FIG. 4 is a side elevational view, partly in section, of the player of the present invention.
Figure 2:
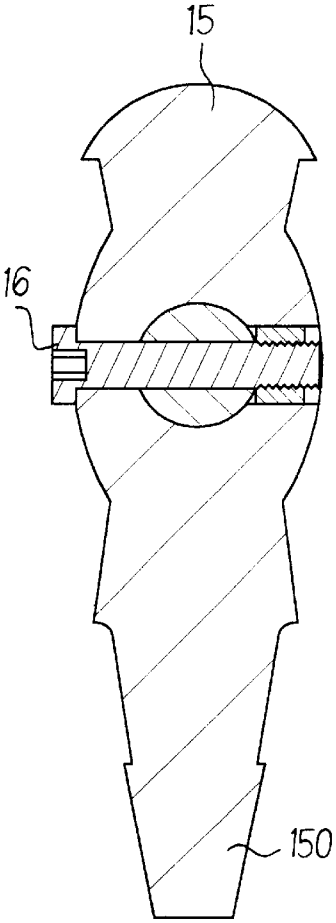
FIG. 2 PRIOR ART
FIG. 2 is a side elevational view, partly in section, of a conventional player in the fooz-ball game.
Figure 5:
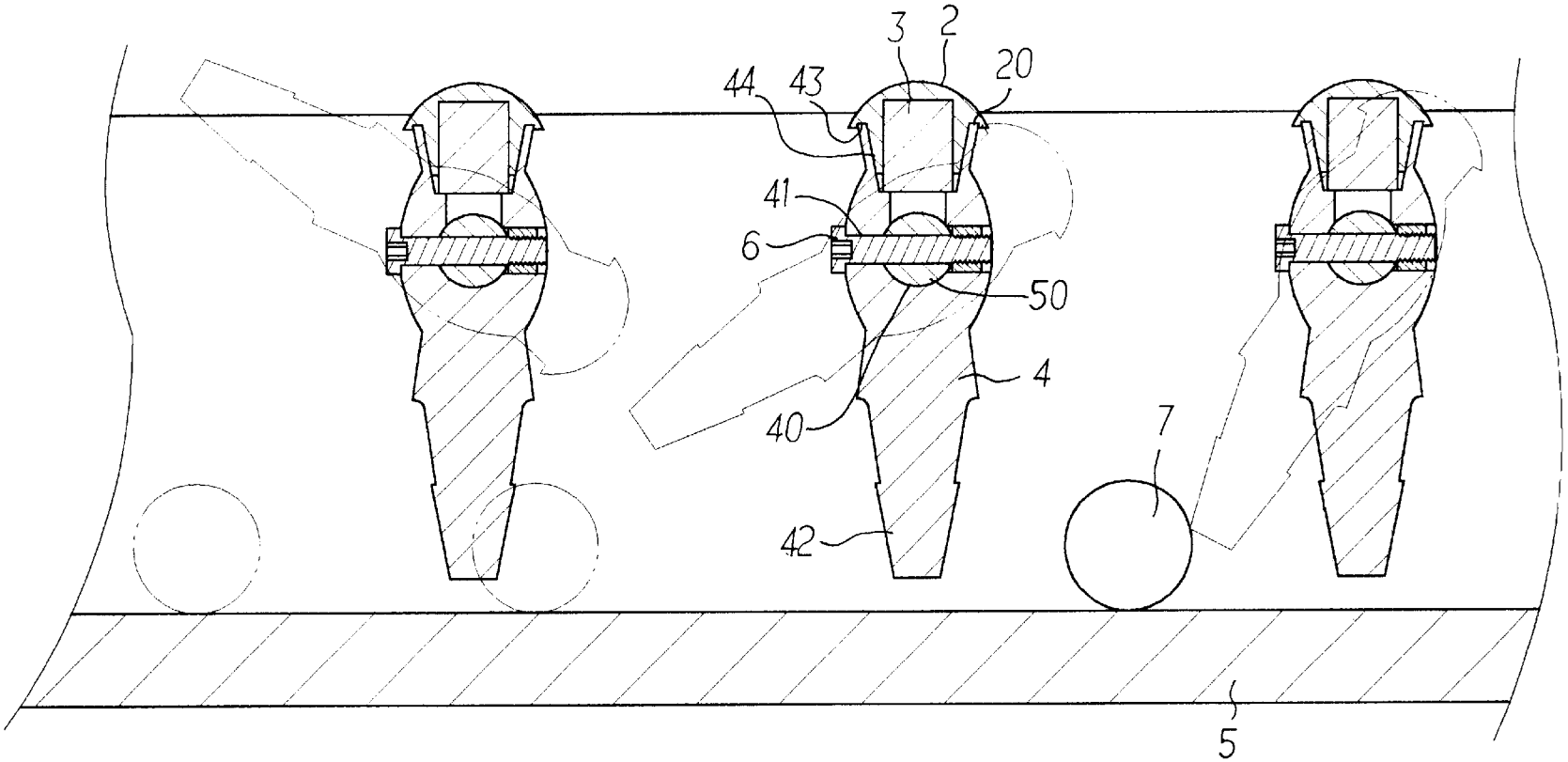
FIG. 5 is a side elevational view, partly in section, of the players which are maintained at a position where the lower end of each player is located above the floor.

Referring to FIGS. 3, 4 and 5, the player in accordance with the present invention comprises a body 4 having a passage 40 defined through the body 4 at a shoulder position of the body 4 so as to allow a shaft 50 (FIG. 5) extend through the passage 40. A bolt receiving hole 410 and a position hole 41 are respectively defined in the body 4 and both communicate with the passage 40. The bolt receiving hole 410 is located in alignment with the position hole 41 which is a hexagonal hole. A bolt 6 extends through the bolt receiving hole 410 and the shaft 10 and is securely engaged with the position hole 41 so that when rotating the shaft 50, the player is rotated with the shaft 50.

A recess 44 is defined in a top of the body 4 and a first weight 3 is received in the recess 44. A second weight 42 is connected to a lower end of the body 4. A cap 2 is mounted to the top of the body 4 and retains the first weight 3 between the recess 44 and the cap 2. The cap 2 has a head 22 and a tubular member 21 extending from a bottom surface of the head 22 and a groove 20 is defined in the head 22 and enclosing the tubular member 21. The tubular member 21 is inserted in the recess 44 and the first weight 3 is received in the tubular member 21. An edge 43 defining the recess 44 in the top of the body 4 is engaged with the groove 20. It is to be noted that the cap 2 can be engaged with the recess 44 by any known ways such as gluing, threading or snapping.

As shown in FIG. 5, because the first weight 3, when the player is rotated over an angle relative to the floor 5 of the game, the lower end of the player can be maintained at a position above the floor 5 so that a ball 7 can pass below the players quickly.

By this way, the game can be played at a quicker speed because the speed of the ball 7 is faster and a distance that the ball 7 moves at each kick is longer than before.

While we have shown and described various embodiments in accordance with the present invention, it should be clear to those skilled in the art that further embodiments may be made without departing from the scope and spirit of the present invention.

What is claimed is:

1. A player structure, comprising:

a body having a passage defined through said body so as to be adapted to allow a shaft to extend through said passage, a bolt receiving hole and a position hole respectively defined in said body and communicating with said passage, said bolt receiving hole located in alignment with said position hole, a bolt extending through said bolt receiving hole and adapted to extend through the shaft and securely engaged with said position hole, a recess defined in a top of said body and a first weight received in said recess, a cap mounted to said top of said body and retaining said first weight between said recess and said cap, said cap having a head and a tubular member extending from said head, said first weight received in said tubular member, a groove defined in said head and enclosing said tubular member, an edge defining said recess in said top of said body being engaged with said groove, a second weight connected to a lower end of said body.

2. The player structure as claimed in claim 1, wherein said position hole is a hexagonal hole.

* * * * *